United States Patent [19]

Neki et al.

[11] Patent Number: 4,578,624

[45] Date of Patent: Mar. 25, 1986

[54] SPEED SETTING ARRANGEMENT FOR SEWING MACHINES

[75] Inventors: Shigeo Neki, Osaka; Nozomu Shinozaki; Takashi Dohi, both of Hirakata, all of Japan

[73] Assignee: Matsushita Electric Industrial Co., Ltd., Osaka, Japan

[21] Appl. No.: 696,885

[22] Filed: Jan. 31, 1985

Related U.S. Application Data

[63] Continuation-in-part of Ser. No. 601,096, Apr. 17, 1984, abandoned, which is a continuation of Ser. No. 328,635, Dec. 8, 1981, abandoned.

[30] Foreign Application Priority Data

Dec. 9, 1980 [JP] Japan ..... 55-174019

[51] Int. Cl.[4] ..... H02K 1/22

[52] U.S. Cl. ..... 318/305; 318/139; 318/342; 318/348; 318/439; 112/277; 338/12; 338/32 R

[58] Field of Search ..... 318/139, 439, 384, 417, 318/357, 358, 305, 301, 257, 316, 342, 348, 317, 331; 329/199, 200; 338/12, 32 R, 32 H; 235/215; 84/1.27; 112/277; 200/86.5; 340/347 P

[56] References Cited

U.S. PATENT DOCUMENTS

| | | | |
|---|---|---|---|
| 3,419,731 | 12/1968 | Wheable et al. | 338/12 X |
| 3,988,710 | 10/1976 | Sidor et al. | 338/32 R |
| 4,132,970 | 1/1979 | Masuda et al. | 338/32 R |
| 4,499,449 | 2/1985 | Shinozaki et al. | 338/32 R |

FOREIGN PATENT DOCUMENTS 55-174019 12/1980 Japan .

*Primary Examiner*—Vit W. Miska
*Assistant Examiner*—Shik Luen Paul Ip
*Attorney, Agent, or Firm*—Lowe, King, Price & Becker

[57] ABSTRACT

A speed setting arrangement for a sewing machine comprises a permanent magnet mounted for unitary rotation with the foot pedal of the sewing machine, and a magnetic sensor including a plurality of magnetoresistors arranged in pairs to form a bridge circuit on a stationary plane spaced a distance from the plane of rotation of the magnet. The magnetic sensor provides an output signal which is exclusively a function of the magnetic orientation of the magnet and thus serves as a valid indication of the amount of pedal depression. An analog to digital converter is coupled to the magnetic sensor to convert its output into a digital signal for speed control purposes.

6 Claims, 9 Drawing Figures

SPEED SETTING ARRANGEMENT FOR SEWING MACHINES

This application is a continuation-in-part of application Ser. No. 601,096, filed 4/17/84, now abandoned, which is a continuation of Ser. No. 328,635, filed on 12/08/81 and now abandoned.

BACKGROUND OF THE INVENTION

The present invention relates generally to sewing machines, and in particular to a speed setting arrangement for sewing machines.

The operating speed of sewing machines is usually controlled with respect to a reference setting speed. Conventional reference speed setting arrangments comprise a set of permanent magnet mounted for rotation with the foot pedal and a magnetic sensor stationarily mounted with respect to the magnet. However, since the signal provided by the magnetic sensor represents the distance to the magnet and since the magnet has a temperature dependent characteristic, the sensor's output signal tends to vary not only as a function of distance to the magnet but also as a function of ambient temperature. The intensity of the magnet also vary as a function of time, or ageing, so that the signal would cease to be a valid indication of the amount of pedal depression. Due to the inherent inaccuracy, the conventional speed setting arrangement additionally requires an optoelectrical device formed by a set of light emitting and receiving elements, and a light intercepting plate for the purpose of generating start-stop signals. The latter is arranged to move with the foot pedal for intercepting the path of light emitted from the light emitting element to the receiving element. This adds to the sewing machine cost and further degrades the reliability of the sewing machine. The inaccuracy of the conventional speed setting arrangement is particularly disadvantageous for digitally processing the speed of sewing machines.

SUMMARY OF THE INVENTION

The primary object of the present invention is therefore to provide a reference speed setting arrangement which is accurate and reliable in operation.

According to the present invention, the speed setting arrangement for a sewing machine comprises a magnet mounted for rotation with the foot pedal of the sewing machine so that the magnet has a different magnetic orientation as a function of the angular displacement of the pedal from a reference point, and a magnetic sensor including a plurality of magnetoresistors connected in pairs to form a bridge circuit on a stationary plane spaced a distance from the plane of rotation of the magnet for generating a signal representative of the magnetic orientation. The stationary plane is spaced a distance from the magnetic plane of rotation so that the magneto resistors are all magnetically saturated by the magnet with the result that the signal output voltage exclusively representative of magnetic orientation exhibits no variations despite any deviation in separation between the magnetic sensor and magnet likely to occur as a result of wear in mechanical parts.

Since the magnetic sensor is exclusively responsive to the magnetic orientation of the rotatably moving magnet, the signal provided by the sensor serves as a valid indication of the amount of pedal depression.

In a preferred embodiment, the magnet is mounted on a driven rotary element which is driven by a driving rotary element coupled for rotation with the foot pedal. The driving element has a larger extent from its axis of rotation to the point of engagement with the driven element having a smaller extent from its axis of rotation. This multiplies the pedal depression providing a sharp definition of sensor's output level. A torsion spring is preferably mounted on one of the rotary elements to provide a pressure contact between them so that the point of contact is rendered invariable during rotation. This eliminates errors due to nonuniformity which might occur in the manufacture of the rotary elements.

BRIEF DESCRIPTION OF THE DRAWINGS

The invention will be described in further detail with reference to the accompanying drawings, in which.

DETAILED DESCRIPTION

Figure 1:
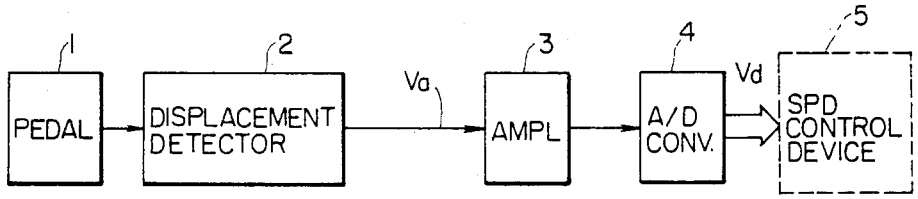
FIG. 1 is a block diagram of the speed control system embodying the invention.

Referring now to FIG. 1, there is schematically shown a speed control system of the present invention. The system comprises a foot pedal 1 of the sewing machine which is linked to a pedal displacement detector 2. The detector 2 senses the angular displacement of the pedal 1 by a sewing machine operator into a signal Va which is an analog representation of the amount of depression with respect to a reference point. The analog signal Va is amplified by an amplifier 3 and fed to an analog to digital converter 4 where the amplified analog signal is converted into a corresponding digital signal Vd. The digitally converted signal is applied to a sewing machine speed control unit.

Figure 2:
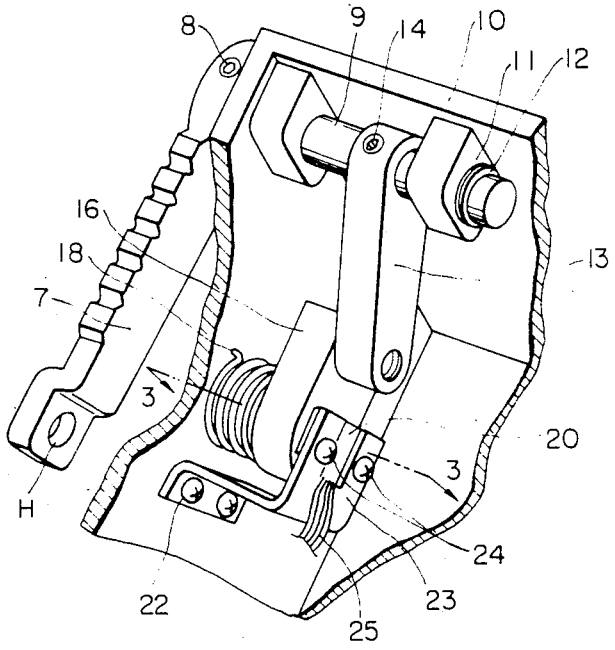
FIG. 2 is a perspective view, in part, of a pedal displacement detector of the invention.
Figure 3:
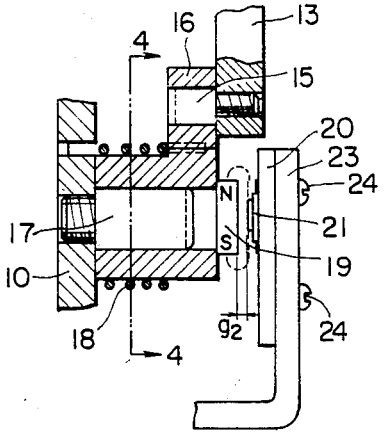
FIG. 3 is a cross-sectional view taken along the line 3—3 of FIG. 2.
Figure 4:
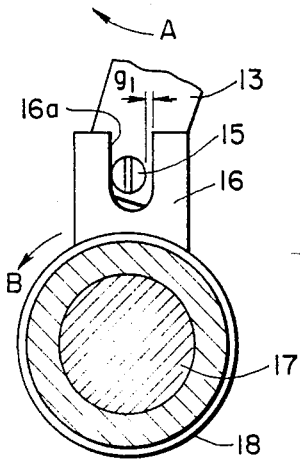
FIG. 4 is a cross-sectional view taken along the line 4—4 of FIG. 3.

Referring to FIGS. 2, 3 and 4, details of the displacement detector 2 is illustrated. The detector 2 comprises a lever 7 secured to a rotary shaft 9 by a screw 8. The rotary shaft 9 is rotatably mounted on a housing 10 and has its one end axially secured by a stop ring 12 and a resin spacer 12 which assures smooth rotation and minimizes play in the axial direction. The lever 7 further includess a hole H in which it receives a connecting rod, not shown, of the foot pedal 1 so that lever 7 is rotatable therewith about shaft 9. To the rotary shaft 9 is rigidly coupled a lever 13 by a screw 14 for rotary movement therewith. A connecting pin 15, threadably engaged with the distal end of the lever 13, extends in a direction parallel with the axial direction of rotary shaft 9 to engage a recess or cutout portion 16*a* of a lever 16 (see FIG. 4) having a larger width than the diameter of the pin 15. The lever 16 is rotatably mounted on a pin 17 secured to the housing 10 and urged by a torsion spring 18 in a clockwise direction as viewed from the left side, for example. The recess 16*a* of the lever 16 has a width larger than the diameter of the connecting pin 15 by an amount g1 to allow pin 15 to keep an intimate contact with an inner wall of the recess 16*a* by the spring action so that gap g1 is always exists on the other side of the recess 16*a* no matter in what direction the levers 13 and 16 may rotate.

On the hub portion of the lever 16 is mounted a permanent magnet 19 with its opposite poles being aligned parallel with the arm portions of the levers 13 and 16.

The pedal displacement detector 2 further includes a magnetic sensor 21 which comprises a plurality of magnetoresistos arranged in pairs to form a bridge circuit on a printed circuit board 20 in proximity to but spaced a distance g2 from the north-to-south pole face of the permanent magnet 19, which is the plane of rotation thereof. The printed circuit board 20 is rigidly secured by screws 24 to a bracket 23 connected to the housing 10 so that the magnetic sensor 21 is stationarily located with respect to the magnet 19.

The bridge circuit magnetoresistance sensor 21 has an advantageous feature in that it ensures a temperature immune sensor output since this output is exclusively a function of the orientation or vector components of magnetic flux rather than as a function of distance to the magnet as in the case of Hall generators. Lead wires 25 feed current to the magnetic sensor 21 and deliver an output signal therefrom to the analog to voltage converter 4.

With a rotation of the foot pedal 1 the lever 13 rotates in a direction A about shaft 9 causing lever 16 to rotate in a direction B about pin 17 against the action of spring 18. The magnetic sensor 21 generates a signal proportional to a combined vector component of the magnetic flux. Since the levers 13 and 16 are in contact with each other by the spring action at all times, the angular displacement of the pedal 1 is accurately transferred to the magnet carrying lever 16 producing a corresponding angular displacement in the latter. Therefore, even if the width of the recess 16*a* has a different value among different levers within the range of tolerance, the displacement detector 2 of the invention has the effect of eliminating such errors.

By appropriately proportioning the lengths of levers 13 and 16, the angular movement of the sewing machine foot pedal is amplified by the ratio of the lever 13 length to the lever 16 length. This amplifying arrangement has the benefit of producing a large analog signal for a given amount of pedal depression. If such amplifying arrangement is not required, the magnet 19 could, of course, be mounted directly on the rotary shaft 9 which, in this instance, is formed of a nonferromagnetic material.

Figure 5:
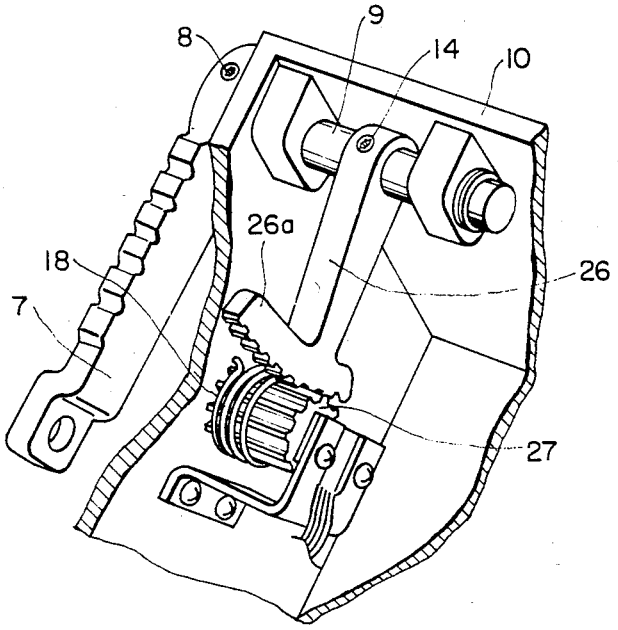
FIG. 5 is a perspective view, in part, of an alternative embodiment of the pedal displacement detector.

FIG. 5 is an illustration of a modified embodiment of the displacement detector 2. In this embodiment, the driving lever 13 is replaced with a lever 26 having an arc-shaped toothed portion 26*a* and the driven lever 16 is replaced with a toothed wheel 27 which is in mesh with the toothed portion 26*a* of lever 26. The torsion spring 18 biases the driven wheel 27 in a circumferential direction as in the previous embodiment to assure intimate contact between the meshed teeth.

Figure 6:
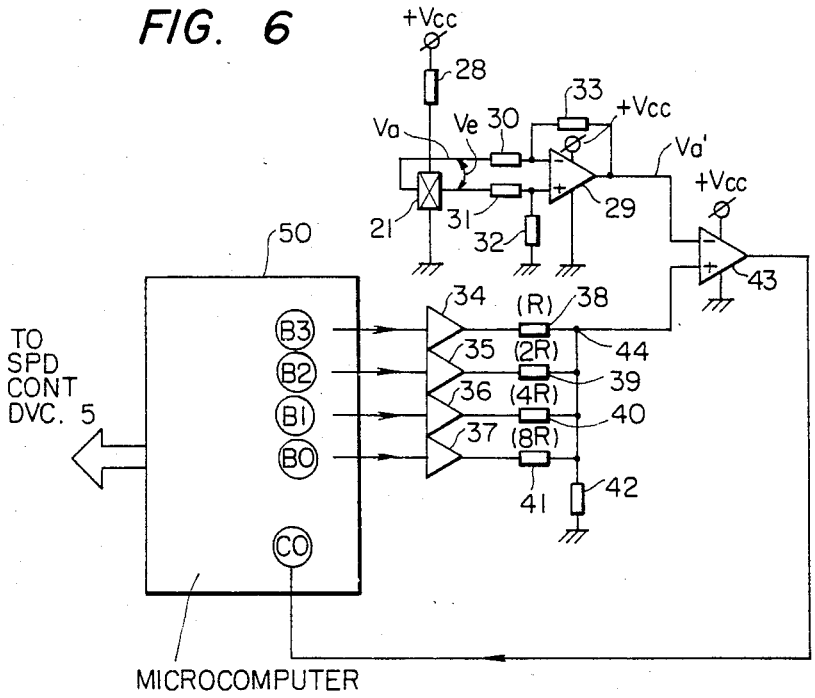
FIG. 6 is a circuit diagram of the amplifer and analog to digital converter of FIG. 1.

Referring to FIG. 6, details of the circuit including magnetic sensor 21, amplifier 3 and analog to digital converter 4 are illustrated. The bridge circuit magnetoresistors has one of its nodes connected to a bias voltage source at +Vcc through a resistor 28 to permit a bias current to drain out of the opposite node which is coupled to ground and has its other nodes coupled to amplifier 3. The amplifier 3 is a differential amplifier formed by an operational amplifier 29, input resistors 30 and 31 through which the sensor voltage Va is applied, and grounding and feedback resistors 32 and 33. The differential output is coupled to the negative input of a comparator 43 to the positive input of which is applied the output of analog to digital converter 4. Depending on the relative magnitude of the input voltages, the comparator 43 provides a logical "0" or "1" output.

The analog to digital converter comprises a microcomputer 50 which takes its input from the output of the comparator 43 and operates on the input signal according to a preprogrammed instructions to apply logical "0" or "1" to output terminals B0, B1, B2 and B3 of which B0 and B3 are least and most significal bits, respectively. The output terminals B0 to B3 are coupled respectively through buffer amplifiers 37, 36, 35 and 34 and through weighting resistors 41, 40, 39, 38 to a common circuit junction at 44 which is grounded by a resistor 42 to develop a digital output voltage thereacross, the circuit junction 44 being coupled to the positive input of the comparator 43 for making a comparison with the analog voltage. The resistors 41, 40, 39 and 38 have a ratio of 8:4:2:1 in their relative resistance values corresponding to the binary levels of four bit positions. The resistor 42 is proportioned so that it develops a maximum voltage which is slightly higher than the maximum value of the analog signal when output terminals B0, B1, B2 and B3 of the microcomputer are all at logical "1". The microcomputer has in its random access memory storage locations designated M0, M1, M2 and M3 which correspond respectively to output terminals B0, B1, B2 and B3.

Figure 7:
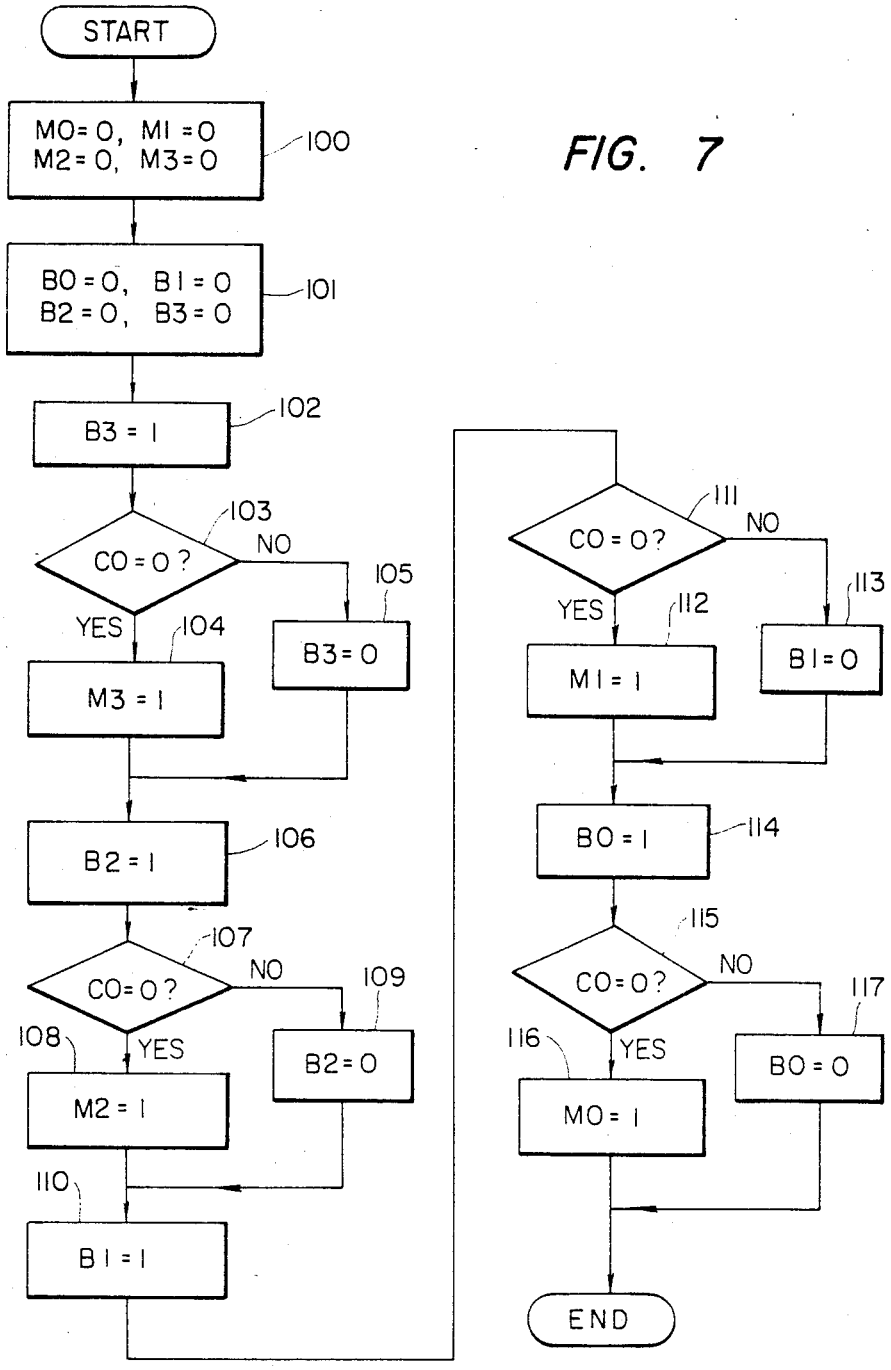
FIG. 7 is a flow diagram describing the programmed steps of the microcomputer of FIG. 6.

The operation of the microcomputer 50 will be visualized with reference to a flow diagram shown in FIG. 7. The program starts at step 100 by initializing, or storing logical "0" in the storage locations M0, M1, M2 and M3, and at step 101 logical "0" is placed on each of output terminals B0, B1, B2 and B3. At step 102, logical "1" is placed on terminal B3 so that a reference voltage of "8" voltage units is developed across the resistor 42 to allow the comparator 43 to make a first comparison with the analog signal. If the latter is higher than the reference voltage, the comparator 43 switches to a low voltage output state to and applies a logical "0" to the microcomputer 50. At step 103, the output of the comparator 43 is matched against logial "0" to check to see if the analog signal is above the binary level 8 and if match occurs, a step 104 is followed wherein a logical "1" is placed on storage location M3 and if not a step 105 is executed to place a logical "0" to output terminal B3. At step 106, a logical "1" is placed on terminal B2 to add up "4" voltage units to the previous reference voltage which depends on which one of the steps 104 and 105 has been executed to allow the comparator 43 to make a second comparison. Therefore, if the input signal is higher than the reference voltage of "8" voltage units, a reference voltage of "12" voltage units will be developed across the resistor 42 and if the input signal lower than that reference level, a reference voltage of "4" voltage units will develop at the resistor 42. The result of the second comparison is checked at step 107 and depending on the output state of the comparator 43 the microcomputer goes to a step 108 to place logical "1" to storage location M2 or to a step 109 to place logical "0" to terminal B2. A third comparison is effected by placing a logical "1" on terminal B1 at step 110 to add up "2" voltage units to the most recent reference voltage. The result of the third comparison is made at step 111 which is followed by either step 112 wherein a logical "1" is stored in memory M1 or by step 113 wherein terminal B1 is reset to logical "0". Similarly, a fourth comparison is made by placing a logical "1" to terminal B0 to add up a voltage unit "1" to the most recent reference voltage at step 114. The result of the fourth comparison is checked at step 115 which is followed by either a step 116 for storing a logical "1" to memory M0 or a step 117 for resetting the terminal B0 to "0".

The analog signal thus repeatedly compared by the comparator 43 is digitally represented by the stored contents of the memories M3, M2, M1 and M0. Assume that the analog signal has 9 voltage units, or volts, for example, the first comparison is made with an initial reference voltage of 8 volts at step 103 which will result in storage of logical "1" at the subsequent step 104. Thus, the reference voltage is increased to 12 volts at step 106 for the second comparison at step 107 which is followed by step 109 to reset B2 to zero, reducing the reference voltage to 8 volts again. At step 110, the reference voltage is increased to 10 volts for the third comparison at step 111. Since comparator 43 generates a logical "1", step 113 follows to reset terminal B1 to "0". Subsequently, the reference voltage is increased to 9 volts at step 114 so that the fourth comparison at step 115 results in a logical "0" output from the comparator 43 to execute the step 116 by storing logical "1" into memory M0. The analog signal of 9 volts is thus represented by memory contents "1 0 0 1" respectively stored in storage locations M3, M2, M1 and M0.

The digital values stored in the memory of the microcomputer 50 are applied to the speed control unit 5 and used as a start-stop signal and a speed setting signal.

Figure 8:
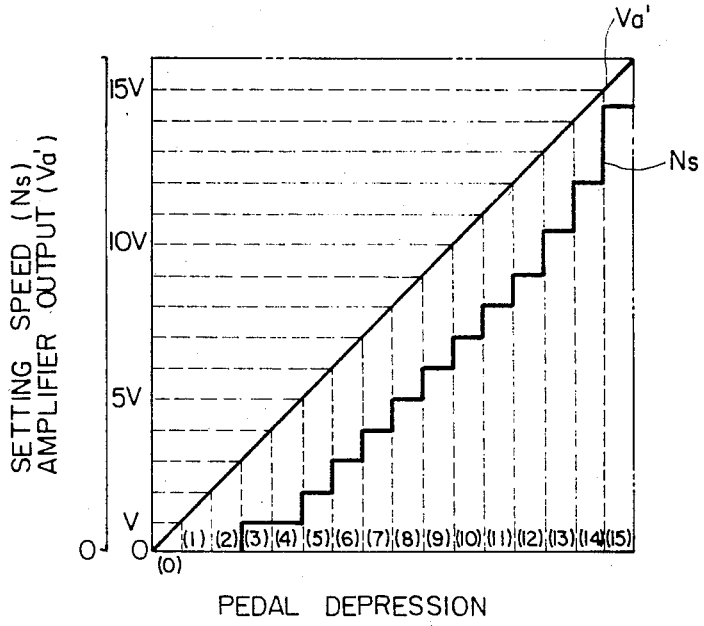
FIG. 8 is a graph illustrating the relationship between the pedal depression and speed of the sewing machine.

FIG. 8 illustrates a typical example of the relationship between the amount of pedal depression, the analog voltage Va' and discretely varying sewing speed Ns. The analog signal, being represented by four bits, can be represented by a total of 16 discrete voltage levels which can be assigned to start-stop functions and speed levels. In FIG. 8, the setting speed Ns has a zero speed, or stop range for pedal depressions in a range from (0) to (2) discrete steps and a low speed range for pedal depression in a range from (3) to (4) discrete steps with the remainder being assigned to medium to high speeds.

Figure 9:
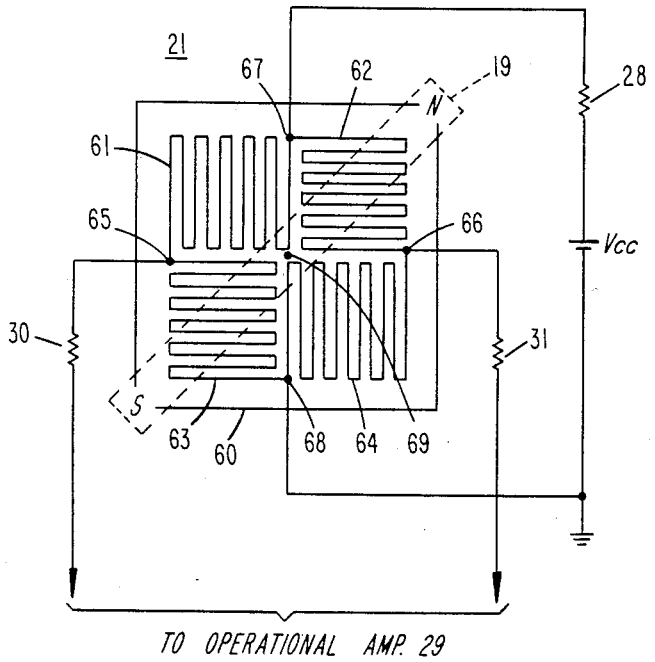
FIG. 9 is an illustration of the magneto resistance angular position sensor according to the present invention when viewed along the rotational axis of the magnet with the magnet shown in phantom superimposed in operating position over the sensor.

FIG. 9 is a detailed illustration of the magneto resistance angular position sensor 21. The sensor 21 comprises an insulative support 60 and a plurality of magneto resistance films 61, 62, 63 and 64 respectively formed on quarter section of the support 60. Each of the magneto resistance films comprises a plurality of parallel strip portions connected in series by intermediate portions. The strip portions of the diagonally located films 61 and 64 are parallel to each other, but perpendular to the strip portions of the diagonally positioned films 62 and 63. These magneto resistance films are connected to each other to form nodes 65, 66, 67 and 68. A bridge circuit is formed by coupling nodes 65–68 to resistors 30, 31, 28 and ground, respectively. A predetermined amount of current is passed through node 67 to 68. The sensor 21 is located in proximity to permanently magnet 19 with the center of rotation of magnet 19 being coaxial to the point of intersection 69 of coordinate axes which divided the sensor 21 into the quarter sections. Sensor 21 is located at such a distance to magnet 19 and is such close axial proximity thereto so that the magneto resistance films are all magnetically saturated by magnet 19. As a result, the voltage developed across nodes 65 and 66 represents exclusively the angular orientation of magnet 19 with respect to the coordinate axes of the center and exhibits no variations despite a deviation in separtion between sensor 21 and magnet 19 which might occur as a result of wear in mechanical parts.

When the magnet flux is parallel to the vertical axis of sensor 21, elements 61 and 64 have a minimum resistance and elements 62 and 63 have a maximum resistance. When the flux is parallel to the horizontal axis of sensor 21, the resistances of elements 61 and 64 increase to maximum and those of elements 62 and 63 decrease to minimum. Because of the bridge circuit configuration, the output voltage of sensor 21 is at a peak value when magnet 19 is aligned to the vertical and at a peak of opposite polarity when it is aligned to the horizontal. By appropriately determining the reference angular position of sensor 21 with respect to magnet 19, the variation of output voltage can be substantially linear.

The foregoing description shown only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A speed setting arrangement for a sewing machine, comprising a manually operated pedal, an elongated rotating magnet for generating a magnetic field having magnetic poles located at diametrically opposite positions of a rotary plane defined by said rotating magnet, said magnet being rotatably coupled with said pedal so that the magnet has in said rotary plane a vector component which is oriented in accordance with the angle of rotation of said pedal, and a sensor having a plurality of magnetoresistance elements arranged on a stationary plane parallel with and axially spaced from said rotary plane and lying on and coaxial to the axis of rotation of said magnet, said magnetoresistance elements being arranged in a circuit for generating a signal exclusively in response to the orientation of said magnetic vector component by being in close axial proximity to said magnet such that the resistance of the magnetoresistance elements magnetically saturates, allowing the signal output voltage to exclusively represent the angular orientation of the magnet and thereby the angle of rotation of the pedal despite deviations in axial separation between the magnets and magnetoresistance elements occurring as a result of mechanical wear.

2. A speed setting arrangement as claimed in claim 1, wherein said magnetoresistance elements are arranged in pairs to form a bridge circuit.

3. A speed setting arrangement as claimed in claim 2, further comprising a differential amplifier coupled to said bridge circuit.

4. A speed setting arrangement as claimed in claim 1, further comprising an analog-to-digital converter for converting said signal to a digital signal.

5. The arrangement of claim 1, wherein said sensor comprises an insulative support carrying plural magnetoresistance films formed on each quarter section of said support, each set of plural magnetoresistance films on each quarter having plural parallel strip portions connected in series by intermediate strip portions, the strip portions of one set of magnetoresistance films being parallel to the strip portions of the diagonally adjacent set of films and perpendicular to the strip portions of non-diagonally adjacent located sets of films, and wherein non-diagonally adjacent magnetoresistance films are connected to each other to form nodes, a bridge circuit being established by coupling said nodes to plural resistors and ground, respectively, said sensor lying on the rotational axis of said magnet such that a point of intersection of coordinate axes which divide said sensor into said quarter sections is coaxial with said rotational axis.

6. A speed setting arrangement for a sewing machine, comprising a manually operated pedal, an elongated rotating magnet for generating a magnetic field having magnetic poles located at diametrically opposite positions of a plane of rotation defined by said rotating magnet, said magnet being rotatably coupled with said pedal so that the magnet has in said plane of rotation a vector component which is oriented in accordance with the angle of rotation of said pedal, and a sensor having a plurality of magnetoresistance elements arranged on a stationary plane parallel with and axially spaced from said rotary plane and lying on and coaxial to the axis of rotation of said magnet, said magnetoresistance elements being arranged in a circuit for generating a signal exclusively in response to the orientation of said magnetic vector component, said elements being further oriented with respect to the magnet to cause the output of the magnetoresistance sensors to be independent of temperature proximate the magnet and sensors within the sewing machine to insure an ambient temperature immune sensor output of said elements.

* * * * *